United States Patent [19]

Wilson

[11] 4,085,463

[45] Apr. 18, 1978

[54] MIXING APPARATUS

[75] Inventor: Charles A. Wilson, Lincoln, R.I.

[73] Assignee: General Signal Corporation, Stamford, Conn.

[21] Appl. No.: 712,177

[22] Filed: Aug. 6, 1976

[51] Int. Cl.[2] ..... B01F 15/02; B01F 5/06

[52] U.S. Cl. ..... 366/176; 366/177; 366/336

[58] Field of Search ..... 259/4 R, 18, 4 AC, 36, 259/4 AB; 137/604, 605, 843, 540, 530

[56] References Cited

U.S. PATENT DOCUMENTS

| | | | |
|---|---|---|---|
| 2,910,998 | 11/1959 | Davis | 137/536 |
| 3,193,257 | 7/1965 | Kingma | 259/4 R |
| 3,709,468 | 1/1973 | Ives | 259/4 R |
| 3,737,148 | 6/1973 | Phillips | 259/4 R |
| 3,788,557 | 1/1974 | Maurice | 137/604 |

*Primary Examiner*—Robert W. Jenkins
*Attorney, Agent, or Firm*—Barlow & Barlow

[57] ABSTRACT

A mixing apparatus and system therefor is disclosed in which two fluid materials are mixed or blended in which the components may vary in viscosity from 1 to 100,000 centipoise. Basically a material which is desired to be emulsified or blended is fed from a source under pressure to a mixing chamber where it is forced through an orifice between the face of an elastomeric plug and its seat and delivered into a turbulent area where the other material is being passed effectively around the periphery of the plug in a turbulent pathway. There is violent agitation caused by the contact between the two materials, one coming at a high velocity from an orifice action coupled to the breaking up of the materials through the turbulent action that produces excellent emulsification for mixing.

4 Claims, 5 Drawing Figures

MIXING APPARATUS

BACKGROUND OF THE INVENTION

In the past in order to mix and emulsify two materials of a liquid nature, it has been necessary to feed them preferably into some form of a mixing vessel which is equipped with mixing device in the form of a propeller-like driven agitator. Devices of this nature take various forms but in general fall in the general class of devices similar to those shown in the Balassa U.S. Pat. No. 3,145,296. There are also other types of mixing devices which have been used in the prior art and for example there are inline mixing devices which consist again of propeller-like structures as shown in the aforementioned Balassa patent inserted into a pipe line. In general, all of these prior art devices draw the material to be mixed toward their propeller-like devices and subject the materials to a shearing action and then pass it back free from swirl or vortex into the main volume of the material. Certain problems have arisen in the mixing or emulsifying of the materials as, for example, certain polymers that have to be wetted and then aged so that they can be handled for further chemical processes. In addition, certain difficulties arise in mixing some acids with water. It is desirable to find devices where uniform homogenization of the materials will occur without deadspots. Other problems exist since there is difficulty in dispersing ingredients that are added with the material to be mixed. For example, if such ingredients were simply scattered on the surface, the flow from the mixing device tends to cause the added materials to be carried outward to the side walls of the mixing vessel causing the added ingredients to stick to the side walls thereof.

SUMMARY OF THE INVENTION

It is therefore an object of the present invention to provide an improved mixing device and apparatus which overcomes the problems of the prior art turbine type mixing devices in vessels. More particularly, it is an object of the invention to provide a mixing apparatus which will be simple and inexpensive to manufacture and operate and which once adjusted will bring the materials to be emulsified into such intimate contact in fine streams under pressure with one or more other solutions that near perfect mixing will be possible. This invention, therefore, provides a mixing apparatus which consists of a pump that is connected to a suitable reservoir containing the resinous or other material which is to be emulsified and the output of this pump is connected to an inlet port of a mixing chamber. The mixing chamber is particularly characterized as being defined by a substantially cylindrical body wall with two end walls, the inlet from the pump passing through one of the end walls centrally thereof. The cylindrical body wall is provided with turbulent producing devices such as flutes and through the cylindrical body wall is another inlet that is adapted to be connected to water under pressure, or, of course, some other liquid, as the case might be. An elastomeric element is urged against the end wall containing the inlet from the pump so as to normally close the inlet and in order to force the resinous or other material which is to be emulsified into the mixing chamber, it will be necessary to exert sufficient pressure against the elastomeric element to lift it off of the seat a sufficient amount so that the resinous or other material will pass between the end wall of the elastomeric element and its seat and thence upward into the mixing chamber proper containing the flutes or other turbulent creating devices. The material to be emulsified, therefore, on the one hand, and the vehicle on the other hand, are forced together in violent agitation causing a breakup of the material such as the resinous material producing excellent emulsifying results primarily due to the fact that the resinous material is subjected to a shearing force as it passes between the end of the elastomeric plug and the end wall of the chamber adjacent the inlet.

DESCRIPTION OF THE PREFERRED EMBODIMENT

Figure 1:
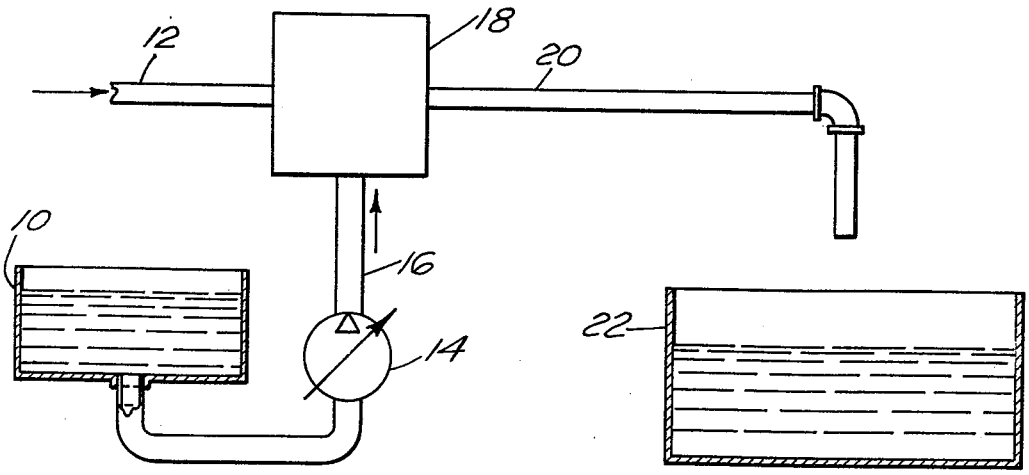
FIG. 1 is a schematic view of the apparatus utilized in connection with the invention.

Referring now more particularly to the drawings 10 designates a reservoir adapted to contain resinous or other material to be emulsified. 12 indicates a supply pipe from a source of water or other liquid under pressure of approximately 40 p.s.i.g. The material to be emulsified in the tank 10 is passed into a metering pump 14 from which it is fed through a conduit 16 to the mixing chamber 18. The mixing chamber 18 is provided with an outlet pipe 20 which can then feed a variety of means such as a holding tank 22.

Figure 2:
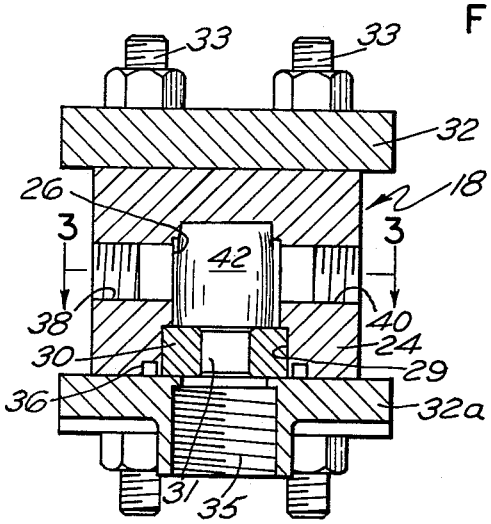
FIG. 2 is a central sectional view of a mixing device made in accordance with the invention.
Figure 3:
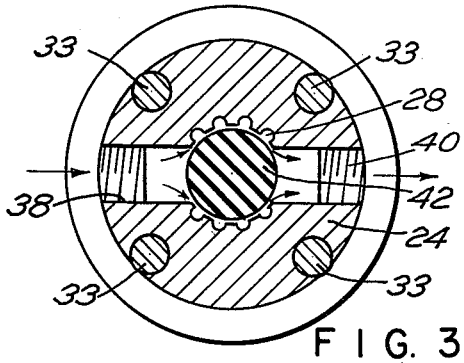
FIG. 3 is a central lateral sectional view of the mixing device on lines 2—2 of FIG. 2.

Referring to FIG. 2 I have shown one form of a mixing chamber generally designated 18 which is illustrated and conveniently made by utilizing a cylindrical body 24 with a central bore 26 therein in which there are provided a number of flutes 28 (see FIG. 3). A counterbore is created at 29 and within this counterbore 29 is a seat member 30 which has a central bore therethrough 31. Conveniently a pair of end plates 32, **32*a* are provided with thru bolts 33. The end plate 32*a* has an inlet port bore 35 that connects directly with the central aperture 31 in the seat member 30. Sealing is provided as an O-ring 36. The body 24 has an inlet port 38 connecting with the chamber or bore 26 and an outlet 40** substantially in line therewith and on the same diameter.

Figure 4:
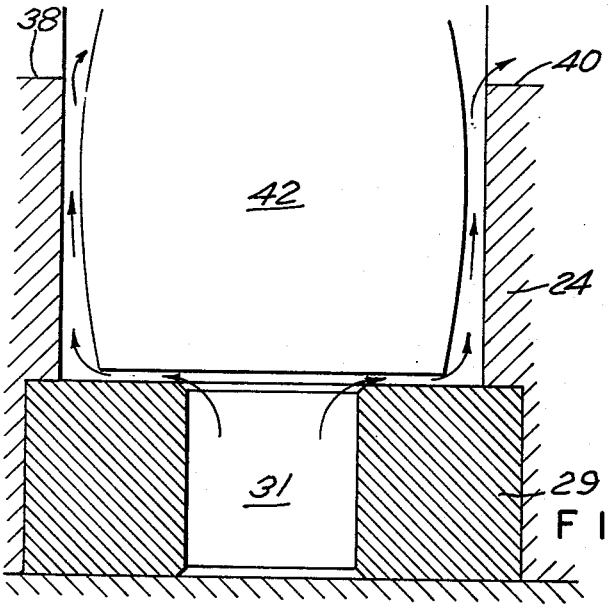
FIG. 4 is an enlarged diagrammatic view illustrating the operation of the mixing device.

In operation as briefly mentioned above, it is necessary to force the resinous or solution to be emulsified into the mixing device or apparatus in such a way that there will be a shearing take place particularly of a resinous material such as a concentrated liquid polymer. It will be recognized that within the inlet pipe 16 the material is under pressure, preferably a pressure on the order of 80 p.s.i.g. We then find that by placing an elastomeric plug 42 within the bore 26 and having the end of the elastomeric cylindrical member bear against the seat member 30 so as to normally close off the aperture 31 therethrough, then as pressure is exerted on the end of this plug, the plug will compress and allow liquid to flow at high shearing velocity between the seat member 30 and the end wall of the elastomeric plug 42 somewhat as diagrammed in FIG. 4, it being understood that the diagram of FIG. 4 is not necessarily to scale and does not represent completely the operation but is somewhat diagrammatic of the fact that a resinous material is directed radially outward between the plug 42 and its seat 30 into collector channels formed by the flutes 28 and thence into the mixing chamber. The mixing chamber is that portion between the outer wall of the plug and the inner edge of the flutes 28 where turbulence is created by the passage of the vehicle across the flutes. Thus, the resinous material or other material is first sheared by the action of the orifice in passing between the end of the plug and the seat member is then directly led into a turbulent zone where it is mixed with the water or vehicle coming in through the inlet and then may be passed out through the outlet 40 and into pipe 20.

It will be apparent that a number of arrangements are possible. For example, if certain controls are placed on the inlet pipe 12 so as to maintain the pressure of the water or the other fluid being fed to the mixer, and a valve is placed therein so as to turn the supply on and off, then in conjunction with the metering pump 14 which has a volume discharge adjustment therein, one can automatically control the mixing that occurs for any batch that would be delivered to reservoir 22. For example, it has been found that when the quantity of material passing out of the metering pump is increased, the end of the elastomeric member 42 will lift further off the seat to maintain the velocity approximately the same at all times as the material is sheared by the orifice type action.

Figure 5:
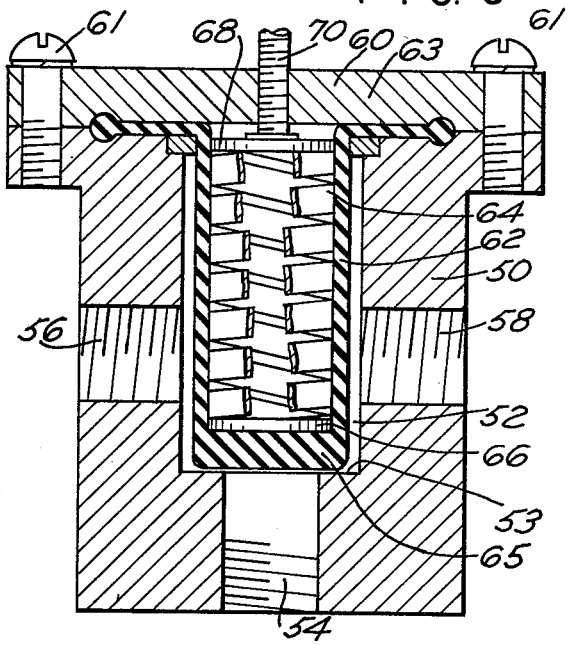
FIG. 5 is a central sectional view illustrating a modified form of mixing device.

Referring to FIG. 5 there is illustrated therein a slightly modified form of mixing chamber which consists of a main body 50 having a fluted chamber 52 therein with inlet ports 54 and 56 communicating with said chamber and an outlet port 58 leaving therefrom. The chamber is closed by a top cover plate 60 suitably held down to the body 50 by fasteners 61. Lying within the chamber 52 is an elastomeric member 62 of sleeve-like formation with an upper annular web 63 that may be clamped in a suitable space between the body 50 and the cover plate 60. A sleeve 62 is internally supported by a flat wall spring member 64 which bears against a plate 66 lying on the bottom of the cylindrical member and which is urged against the bottom 65 of the cylindrical member by an upper pressure plate 68 with a threaded adjustment screw 70 passing through a threaded bore in the cover plate 60 providing a suitable compressive stress on the spring member 64.

In operation, the embodiment of FIG. 5 works in precisely the same fashion that the embodiments of FIGS. 2 and 3 operate that is to say, the cylindrical elastomeric member 62 is urged against the bottom wall 53 of the chamber 52 with a sufficient force by virtue of the spring member 64 so that considerable pressure must be exerted thereagainst by the metering pump 14 and raise the same and create the shearing action to the viscous polymer or resinous material that might be fed therethrough. Similarly the chamber 52 has the same type of turbulent creating devices, namely flutes, therein, and thus complete mixing occurs in precisely the same fashion.

It is seen that there has been disclosed herein a mixing apparatus consisting of a particularly formed and arranged chamber which shears and disperses concentrated viscous materials into a dilution. The emulsification or dispersion is accomplished by the passage of the viscous materials through an orifice lying between the underside of an elastomeric plug and its seat. In the complete system it will be obvious that the viscous material fed through the metering pump both measures the required quantity of the viscous material and hydraulically inloads the elastomeric plug to create the high velocity orifice. Turbulent flow of water or other solution is created by the passage thereof around the elastomeric member across and at right angles to the flutes or other turbulent creating devices in the mixing chamber around the plug. The elastomeric member may be made of a number of materials, for example, a chlorosulforated polyethylene or a fluorocarbon rubber, and to avoid corrosive action, the body members may be made of a 316 series of stainless steel ABS type plastic material or any number of other plastics such as polyethylene and the like.

I claim:

1. In combination a pump, said pump having an inlet connected to a supply of a first liquid material, a mixing chamber, a supply of a second liquid vehicle material connected to said chamber, the output of said pump connected to said mixing chamber, an elastomeric plug retained in said chamber, said plug having a solid wall, means including an inlet leading into said chamber, a seat about said inlet, said plug wall being urged against said seat, the pressure developed by said pump forcing the plug away from the seat to create an orifice whereby the first material is passed through said orifice into said chamber, said second material being passed into said chamber, discontinuities in the wall of said chamber substantially at right angles to the second material flow which creates turbulence, and a receiver for the output of said mixer.

2. A mixing chamber defined by a substantially cylindrical body wall, upper and lower end walls, two inlets and an outlet leading into said chamber, one inlet extending through an end wall and another inlet extending through the cylindrical wall, an elastomeric element urged against said end wall to normally close said one inlet, said cylindrical wall having turbulence producing flutes therein, said element being adapted to be displaced from said one inlet by pressure to create an orifice.

3. A mixing chamber as in claim 2 wherein the elastomeric element is a solid plug.

4. A mixing chamber as in claim 2 wherein the elastomeric element is a mechanically spring loaded member.

* * * * *